US005078215A

United States Patent [19]

Nau

[11] Patent Number: 5,078,215

[45] Date of Patent: Jan. 7, 1992

[54] METHOD AND APPARATUS FOR CONTROLLING THE SLOPE OF A BLADE ON A MOTORGRADER

[75] Inventor: Kevin R. Nau, Tipp City, Ohio

[73] Assignee: Spectra-Physics Laserplane, Inc., Dayton, Ohio

[21] Appl. No.: 530,905

[22] Filed: May 29, 1990

[51] Int. Cl.[5] ..... E02F 3/76

[52] U.S. Cl. ..... 172/4.5; 37/DIG. 14; 37/DIG.20

[58] Field of Search ..... 172/4.5; 37/DIG. 20, 37/DIG. 1, DIG.19

[56] References Cited

U.S. PATENT DOCUMENTS

| | | | |
|---|---|---|---|
| 3,786,871 | 1/1974 | Long et al. | 172/4.5 |
| 3,791,452 | 2/1974 | Long et al. | 172/4.5 |
| 4,081,033 | 3/1978 | Bulger et al. | 172/4.5 |
| 4,156,466 | 5/1979 | Caldwell | 172/4.5 |
| 4,213,503 | 7/1980 | Elmberg et al. | 172/4.5 |
| 4,431,060 | 2/1984 | Scholl et al. | 172/4.5 |
| 4,545,439 | 10/1985 | Sollett et al. | 172/4.5 |
| 4,696,486 | 9/1987 | Ruhter . | |
| 4,918,608 | 3/1990 | Middleton et al. | 172/4.5 |
| 4,924,374 | 5/1990 | Middleton et al. | 172/4.5 |
| 4,926,948 | 5/1990 | Davidson et al. | 172/4.5 |

FOREIGN PATENT DOCUMENTS

| | | |
|---|---|---|
| 3610666 | 10/1987 | Fed. Rep. of Germany . |
| 173232 | 10/1983 | Japan . |
| 102023 | 6/1984 | Japan . |

OTHER PUBLICATIONS

Cat Automatic Blade Control, 10-1979.

*Primary Examiner*—Dennis L. Taylor
*Assistant Examiner*—Spencer Warnick
*Attorney, Agent, or Firm*—Killworth, Gottman, Hagan & Schaeff

[57] ABSTRACT

A method and apparatus is provided for controlling the parallel blade slope angle of a blade in order to maintain a desired cross slope during normal operation of a motorgrader regardless of whether the motorgrader is turning, the front wheels are side-tilted or the blade supporting A-frame is side-shifted. The present invention controls the cross slope angle cut by the blade of a motorgrader by substantially continuously sensing the perpendicular slope angle of the blade by means of a slope sensor and the angle of rotation of the blade relative to the direction of the travel by means of a noncontact sensor. The sensed angles are used to calculate the parallel slope angle of the blade relative to horizontal which is required to maintain a desired cross slope angle. The parallel slope angle is sensed by means of the slope sensor and controlled such that it is maintained substantially equal to the calculated parallel slope angle to thereby define the desired cross slope angle set by an operator.

21 Claims, 6 Drawing Sheets

METHOD AND APPARATUS FOR CONTROLLING THE SLOPE OF A BLADE ON A MOTORGRADER

CROSS REFERENCE TO RELATED APPLICATIONS

Reference is hereby made to the following co-pending applications, dealing with related subject matter and assigned to the assignee of the present invention: "Method and Apparatus For Controlling Motorgrader Cross Slope Cut," by Davidson et al, assigned U.S. Ser. No. 372,909 and filed June 28, 1989, and "Method and Apparatus For Controlling Slope of Vehicle Carried Tool," by Douglas, assigned U.S. Ser. No. 423,266 and filed Oct. 18, 1989.

BACKGROUND OF THE INVENTION

The present invention relates generally to a control system for controlling a blade carried by a motorgrader used for earthworking and, more particularly, to an improved method and apparatus for controlling the slope of the blade in order to maintain a desired cross slope angle of the surface being worked by the motorgrader.

Control systems for controlling the slope of blades on motorgraders have been utilized in practice in the prior art. For example, a control system is known which employs multiple angle sensors and multiple slope sensors for controlling the slope of a blade on a motorgrader having a two-part articulated frame defined by a rear drive unit and a front steering unit. This blade control system references the orientation of the blade back through the various members of the machine to the rear drive unit. It assumes that the motorgrader is not executing a turn, that the front wheels are not side-tilted and that the blade supporting A-frame is not side-shifted. If one or more of these assumptions is incorrect during operation, the control system will not be able to accurately control the blade slope angle to maintain a desired cross slope. U S. Pat. No. 4,431,060 discloses a further control system for controlling the slope of a blade 30 on a motorgrader including a ground engaging trailing wheel assembly 96. The assembly 96 includes a pitch accelerometer 128 purportedly for sensing the pitch of the blade 30 and a slope accelerometer 130 purportedly for sensing the slope of the blade 30. A trailing wheel 116, which is mounted onto a shaft 110 of the assembly 96, follows behind the blade 30 and remains aligned in the direction of travel of the motorgrader.

The pitch and slope accelerometers 128 and 130 are mounted within a support housing 108 which is rotatably mounted onto the shaft 110. A potentiometer 124 is also mounted to the housing 108 while an adjustable input shaft 126 thereof is secured to a support member 122 which rotates with the blade 30. As the blade 30 is rotated, shaft 110 is rotated by the trailing wheel 116 so that the housing 108 remains in alignment with the direction of travel of the motorgrader. Since the potentiometer 124 remains in alignment with the direction of travel of the motorgrader while its input shaft 126 rotates with the blade 30, the potentiometer is able to sense the degree of rotation of the blade 30. By employing the slope, the pitch, the angle of rotation of the blade and other sensed values, the control system operates to maintain the blade 30 at a desired slope.

This control system is problematic because it employs a ground contact sensor, which includes the trailing wheel 116. When the trailing wheel 116 hits disturbances, such as rocks or clumps of dirt, it is knocked out of alignment from the direction of travel of the motorgrader. As a result, error in the output from the slope and pitch accelerometers 130 and 128 will result since they are mounted to the housing 108, which rotates with the trailing wheel 116. Further, if the trailing wheel 116 looses contact with the ground, such as when the blade is raised, error again will occur in the output from the accelerometers 130 and 128. Finally, due to the environment in which motorgraders are employed, there is a risk that the ground contact trailing wheel assembly might be damaged or torn from the motorgrader while in use.

Therefore, a need exists for an improved blade angle control system capable of measuring the angle of rotation of a blade relative to the direction of movement by a sensor which can be reliably mounted onto a motorgrader without substantial risk of being damaged or torn from the machine. Preferably, the blade angle control system would be capable of accurately measuring the parallel and perpendicular slopes of the blade and control the blade slope without requiring multiple angle sensors as in the prior art.

SUMMARY OF THE INVENTION

The blade angle control method and apparatus of this invention is capable of accurately controlling the parallel blade slope angle of a blade in order to maintain a desired cross slope during normal operation of a motorgrader regardless of whether the motorgrader is turning, the front wheels are side-tilted or the blade supporting A-frame is side-shifted. The present invention controls the cross slope angle cut by the blade of a motorgrader by substantially continuously sensing the perpendicular slope angle of the blade by means of a slope sensor and the angle of rotation of the blade relative to the direction of travel by means of a noncontact sensor. The sensed angles are used to calculate the parallel slope angle of the blade relative to horizontal which is required to maintain a desired cross slope angle. The parallel slope angle is sensed by means of the slope sensor and controlled such that it is maintained substantially equal to the calculated parallel slope angle to thereby define the desired cross slope angle set by an operator. The parallel slope angle calculation is performed by repetitively solving the following equation:

$$\tan B = \frac{\tan A - (\tan C)(\sin D)}{\cos D}$$

where B is the required parallel slope angle of the blade; A is the desired cross slope angle of the surface which is entered by an operator of the motorgrader; C is the sensed perpendicular blade slope angle of the blade; and D is the measured angle of rotation of the blade relative to its direction of travel.

In accordance with one aspect of the present invention, a control system for controlling the position of an adjustably movable tool having a working edge carried by a vehicle in order to maintain a desired cross slope angle of a surface being worked by the vehicle comprises: input means for selecting a desired cross slope angle of the surface being worked; slope sensor means for sensing the parallel slope angle of the tool parallel to its working edge and relative to horizontal and the perpendicular slope angle of the tool perpendicular to its working edge and relative to horizontal; tool angle measuring means located on the vehicle out of contact with the surface for measuring the angle of rotation of the tool relative to the direction of travel of the tool; and processor means connected to the input means, the slope sensor means and the tool angle measuring means for controlling the parallel slope angle of the tool to maintain the desired cross slope angle of the surface.

The parallel slope angle of the tool required to maintain the desired cross slope angle is calculated by the processor means using the equation:

$$\tan B = \frac{\tan A - (\tan C)(\sin D)}{\cos D}$$

where B is the required parallel slope angle of the tool; A is the desired cross slope angle of the surface; C is the sensed perpendicular slope angle of the tool; and D is the measured angle of rotation of the tool relative to the direction of travel of the tool, and the processor means controls the parallel slope of the tool so that the sensed parallel slope angle of the tool is substantially equal to the calculated parallel slope angle of the tool to maintain the desired cross slope angle of the surface being worked by the vehicle.

The vehicle may further comprise ring means for mounting the tool to the vehicle. The slope sensor means and the tool angle measuring means may be mounted onto the ring means. The slope sensor means may comprise first and second slope sensors, for example, two level vial sensors. Alternatively, the slope sensor means may comprise a single dual axis slope sensor. The tool angle measuring means may comprise at least one doppler effect device.

In accordance with another aspect of the present invention, apparatus is provided for controlling the cross slope angle of a surface being worked by a motorgrader. A blade with a cutting edge is supported upon a ring unit on the motorgrader. The blade and the ring unit are rotatable about a generally vertical axis and are mounted for adjustment of the elevations of the ends of the blade to define a parallel slope angle of the blade relative to horizontal. Input means are provided so that an operator of the motorgrader can select a desired cross slope angle of the surface being worked. Slope sensor means sense the parallel slope angle of the blade parallel to its cutting edge and relative to horizontal and the perpendicular slope angle of the blade perpendicular to its cutting edge and relative to horizontal. Noncontact blade angle measuring means are located on the motorgrader out of contact with the surface for measuring the angle of rotation of the blade relative to the direction of travel of the blade. Processor means connected to the input means, the slope sensor means and the blade angle measuring means control the parallel slope angle of the blade to maintain the desired cross slope angle of the surface.

The parallel slope angle of the blade required to maintain the desired cross slope angle is calculated by the processor means using the equation:

$$\tan B = \frac{\tan A - (\tan C)(\sin D)}{\cos D}$$

wherein B is the required parallel slope angle of the blade; A is the desired cross slope angle of the surface; C is the sensed perpendicular blade slope angle of the blade; and D is the measured angle of rotation of the blade relative to the direction of travel of the blade. The processor means controls the parallel slope of the blade so that the sensed parallel slope angle of the blade is substantially equal to the parallel slope angle of the blade calculated using the equation to maintain the desired cross slope angle of the surface being worked by the motorgrader.

The slope sensor means and the blade angle measuring means are preferably mounted onto the ring unit. The slope sensor means may comprise first and second slope sensors, for example, two level vial sensors. Alternatively, the slope sensor means may comprise a single dual axis slope sensor. The blade angle measuring means may comprise at least one doppler effect device.

In accordance with a further aspect of the present invention, a method is provided for controlling the cross slope angle of a surface being worked by a motorgrader wherein a blade is supported upon a ring rotatable about a generally vertical axis. The ring and blade unit are mounted for adjustment of the elevations of the ends of the blade to define a parallel slope angle of the blade relative to horizontal. The method comprises the steps of: selecting a desired cross slope angle; sensing the parallel slope angle of the blade parallel to its cutting edge and relative to horizontal; sensing the perpendicular slope angle of the blade perpendicular to its cutting edge and relative to horizontal; providing noncontact angle measuring means mounted onto the motorgrader out of contact with the surface; measuring the angle of rotation of the blade relative to the direction of travel of the blade with the angle measuring means, controlling the parallel slope angle of the blade as a function of the desired cross slope, the perpendicular slope angle of the blade and the angle of rotation of the blade relative to the direction of travel of the blade to maintain the desired cross slope angle of the surface being worked by the motorgrader.

The step of controlling the parallel slope angle of the blade as a function of the desired cross slope, the perpendicular slope angle of the blade and the angle of rotation of the blade relative to the direction of travel of the blade may comprise the steps of: calculating the required parallel slope angle using the equation:

$$\tan B = \frac{\tan A - (\tan C)(\sin D)}{\cos D}$$

where B is the required parallel slope angle of the blade; A is the desired cross slope angle of the surface; C is the sensed perpendicular blade slope angle of the blade; and D is the measured angle of rotation of the blade relative to the direction of travel of the blade; and controlling the parallel slope of the blade so that the sensed parallel slope angle of the blade is substantially equal to the calculated parallel slope angle of the blade to maintain the desired cross slope of the surface being worked by the motorgrader.

The step of sensing the parallel slope angle of the blade and the step of sensing the perpendicular slope angle of the blade, may comprise the step of providing a slope sensor means located on the ring unit. The step of providing angle measuring means, may comprise providing noncontact angle measuring means located on the ring unit. The angle measuring means may comprise at least one doppler effect device. The slope sensor means may be located on the ring unit and may comprise first and second slope sensors, for example, two level vial sensors.

Accordingly, it is an object of this invention to provide a method and apparatus for controlling the cross slope of the cut being made by a motorgrader during normal operation of the motorgrader regardless of whether the motorgrader is executing a turn, the front wheels are side-tilted or the blade supporting A-frame is side-shifted, wherein the number of machine sensors is reduced and includes at least one surface sensitive sensor which does not contact the surface. Other objects and advantages of the invention will be apparent from the following description, the accompanying drawings and the appended claims.

DETAILED DESCRIPTION OF THE INVENTION

Figure 2:
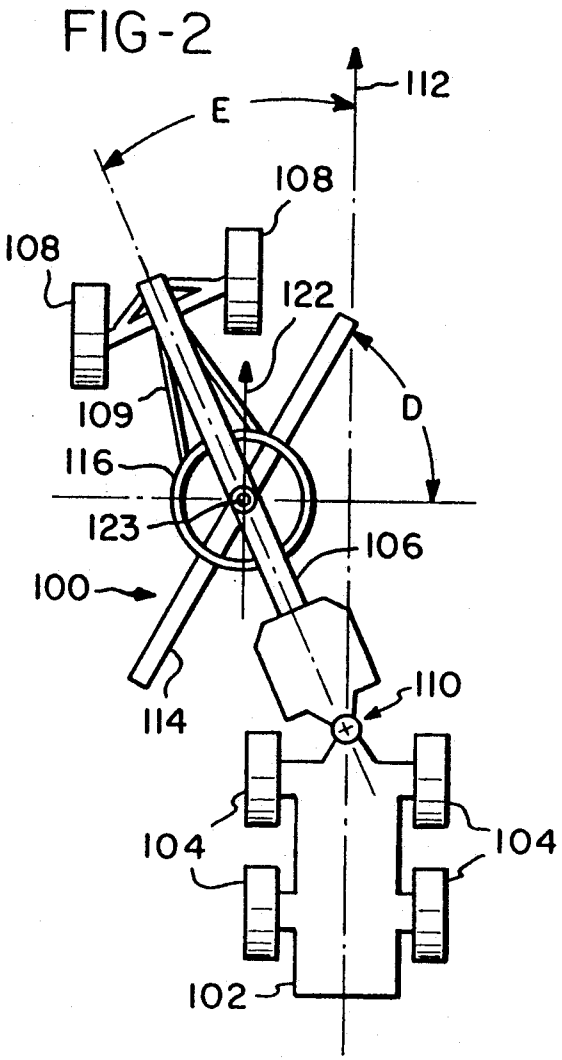
FIGS. 1 and 2 are schematic plan views of articulated frame motorgraders illustrating straight frame operation and articulated frame operation, respectively.
Figure 1:
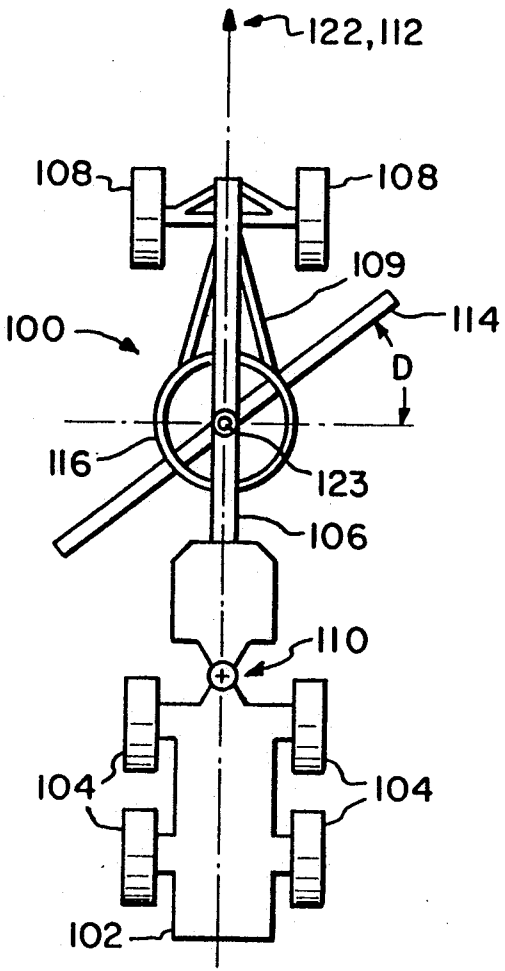

Reference is now made to the drawing figures wherein FIGS. 1 and 2 schematically illustrate a two-part articulated frame motorgrader 100 in plan view. The motorgrader 100 includes a rear drive unit 102 including rear drive wheels 104 and a front steering unit 106 including front steering wheels 108. The front steering unit 106 is connected to the rear drive unit 102 by a frame articulation joint 110 so that the steering unit 106 can be rotated relative to the drive unit 102 to assist the steering wheels 108 in steering the motorgrader 100 and to permit "crabbed" steering of the motorgrader 100 as shown in FIG. 2. While straight frame operation as shown in FIG. 1 is used much of the time, it is often desireable to operate the motorgrader 100 with the steering unit 106 rotated at a selectable angle E relative to the drive unit 102, but traveling in a direction 112, which is referred to as crabbed steering.

Figure 3:
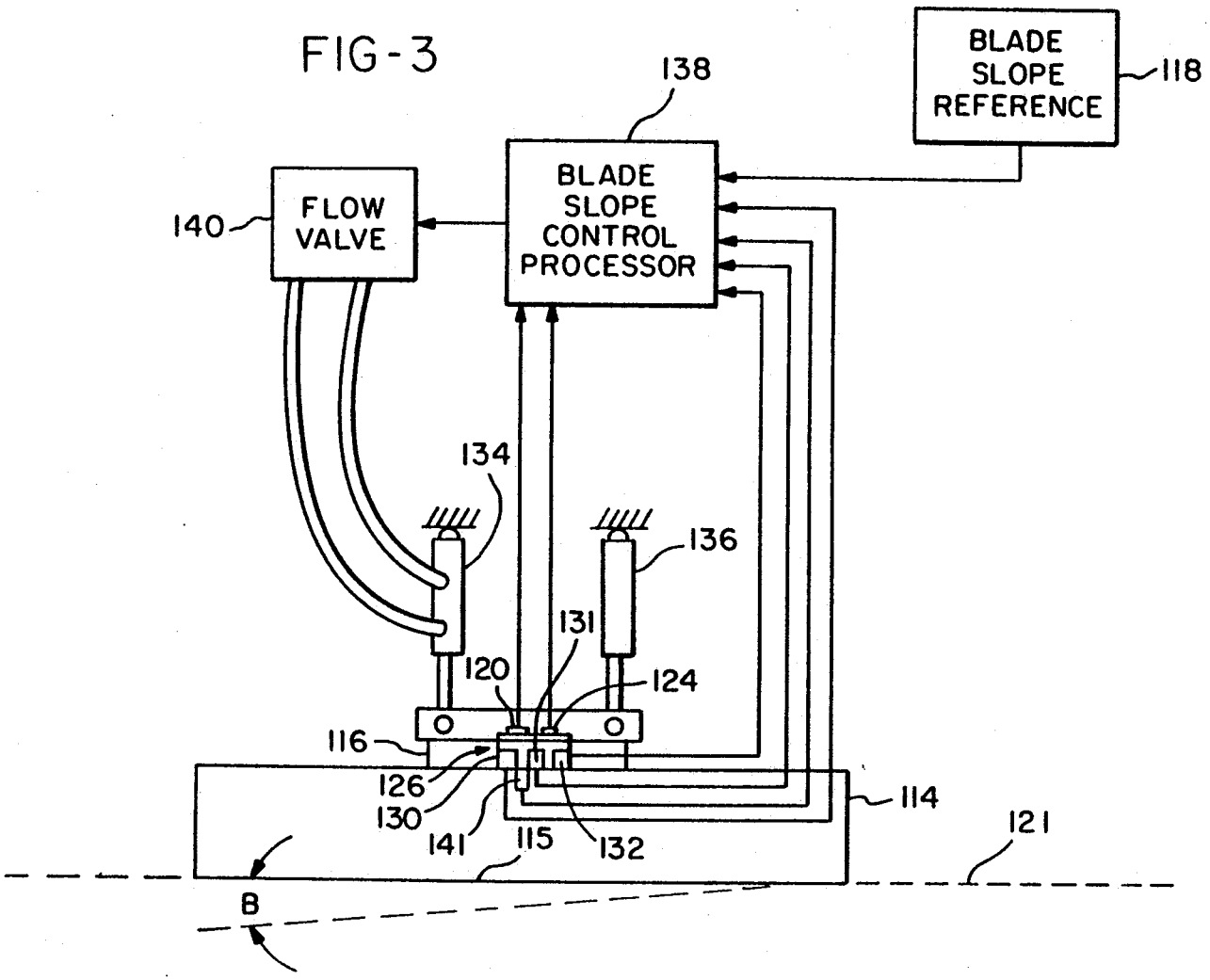
FIG. 3 is a schematic block diagram showing the application of the present invention for cross slope control in a motorgrader.

A blade 114 having a cutting edge 115, see FIG. 3, is supported upon the steering unit 106 by ring means comprising a circle or ring 116 so that the blade 114 can be rotated about a generally vertical ring rotation axis 123 collinear with the center of the ring 116, see FIGS. 1, 2, 4 and 8. The ring 116 is connected to the steering unit 106 by way of an A-frame 109 which may be side-shifted by an operator to the left or right of a center position, as is well known in the art. The blade 114 is shown in FIGS. 1 and 2 as moving in a direction of travel 122 which may be parallel to the direction of travel 112 of the motorgrader 100. The direction of travel 122 of the blade 114; however, may not always be parallel to the direction of travel of the motorgrader 100. For example, the direction of travel 122 of the blade 114 varies from the direction of travel of the motorgrader 100 when the motorgrader 100 is executing a turn.

Figure 11:
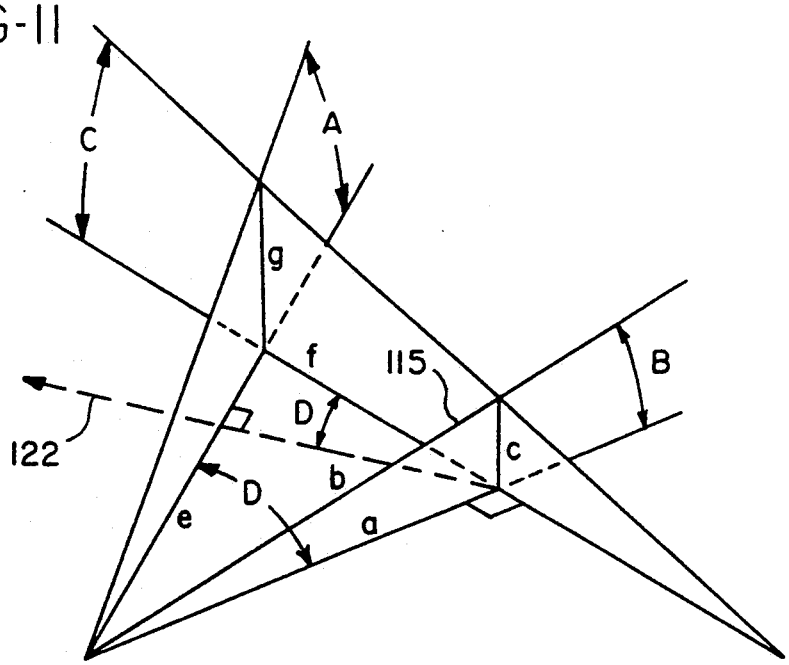
FIG. 11 is a line drawing illustrating blade movement and used to illustrate derivation of the equation used to calculate the required parallel blade slope angle of the blade for a desired cross slope.

In accordance with the present invention, a method and apparatus are provided to control the cross slope. i.e.. the slope normal to the direction of travel of the motorgrader 100, of the cut being made during normal operation of the motorgrader 100 including operation in a crabbed steering position. The method and apparatus also maintains the cross slope of the cut regardless of whether the motorgrader 100 is executing a turn, the front wheels are side-tilted or the A-frame 109 is side-shifted. The apparatus required for operation of the present invention includes input means comprising an input device 118, as shown in FIG. 3, such as a keyboard or the like, for selecting a desired cross slope angle A, see FIG. 11. The input device 118 is typically mounted in the operator's cab (not shown) for the motorgrader 100.

First slope sensor means comprising a slope sensor 120 may be employed to sense the parallel slope angle B of the blade 114 parallel to its cutting edge 115 and relative to horizontal 121. The parallel slope angle B of the blade 114 is sometimes referred to in the art as the blade slope angle of the blade. As shown schematically in FIG. 3, the slope sensor 120 is mounted onto the ring 116; however, it can be mounted onto the blade 114 or other blade supporting structure as preferred for a given application. Second slope sensor means comprising a slope sensor 124 may be employed to sense the perpendicular slope angle C of the blade 114 perpendicular to its cutting edge 115 and relative to horizontal. While the preferred embodiment employs the perpendicular slope angle of the blade 114 to control the cross slope, it is also contemplated that the longitudinal slope of the overall motorgrader in the direction of travel may be sensed and employed in substitution for the perpendicular slope angle. The slope sensor 124 is shown mounted onto the ring 116; however, it can also be mounted onto the blade 114 or other blade supporting structure. The first and second slope sensors 120 and 124 can comprise, for example, fluid filled vials which form electrolytic potentiometers for monitoring the parallel blade slope angle and the perpendicular blade slope angle, respectively.

Figure 10:
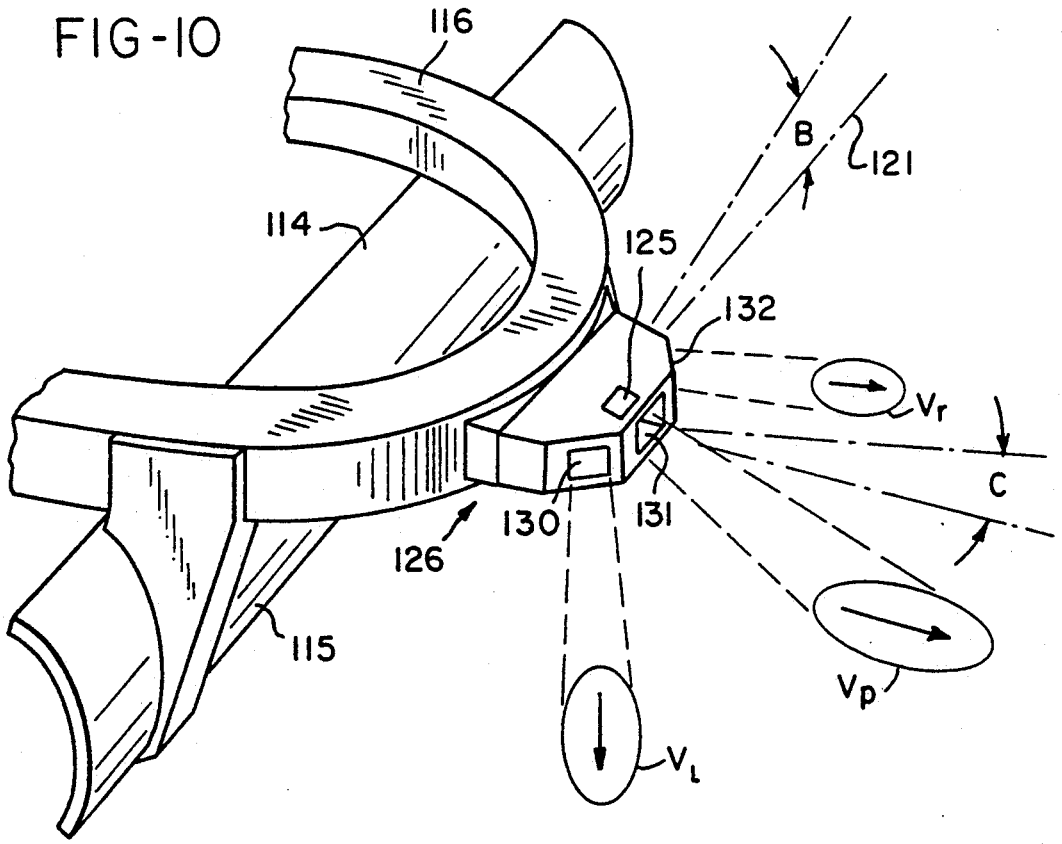
FIG. 10 is a partial schematic perspective view of a ring of a motorgrader having a blade, slope sensors and doppler effect devices attached thereto.

Alternatively, a single slope sensor 125 may be employed, as shown schematically in FIG. 10, for sensing the parallel slope angle B and the perpendicular slope angle C in the place of the slope sensors 120 and 124. Such a sensor may comprise a dual axis slope sensor which utilizes a fluid filled hemisphere, commercially available from Schaevitz, having the tradename Dual Axis Clinometer.

Noncontact blade angle measuring means 126 are shown located on the ring 116 out of contact with the surface being graded for measuring the angle of rotation D of the blade 114 relative to the direction of travel 122 of the blade. The blade angle measuring means 126 may also be located on the blade 114 or other blade supporting structure. The blade angle measuring means 126 may comprise a plurality of velocity transducers for measuring the ground velocity vector Vg in the direction of travel of the blade 114. The velocity transducers may comprise, for example, three doppler effect devices 130–132 (radar guns), as shown in FIGS. 3, 4, 6 and 10, commercially available from Dickey John Corp., model No. DJRVS II. Each of the devices 130–132 produces a signal which is aimed at the moving surface and reflected back. The reflected signal will experience a doppler shift in frequency which is measured by each of the devices 130–132. Based upon the measured doppler shift in the transmitted frequency, each of the devices 130–132 can determine the magnitude of the component of the ground velocity vector Vg which extends along the center of its respective signal beam. As will be discussed in more detail below, by determining the components of the ground velocity vector Vg, the angle of rotation D of the blade 114 may be determined.

In FIG. 3, a blade cross slope control system operable in accordance with the present invention for the blade 114 of the motorgrader 100 is shown in schematic block diagram form from a rear view of the blade 114. The elevation of the ring 116 and hence the elevation of the blade 114 is controlled by a pair of hydraulic cylinders 134 and 136 which are well known and hence only shown schematically in the block diagram of FIG. 3. The blade slope control processor 138 controls the cylinder 134 via an operator of the motorgrader 100 or an elevation positioning device (not shown), such as a laser control system or a string line control system, which is well known in the art and hence not described herein. It should be apparent that other earthworking tools in addition to a grader blade can be mounted in a variety of ways such that the blade or other tool is supported by a pair of hydraulic cylinders, such as the cylinders 134 and 136, which control both the elevation and parallel slope of the blade or other tool.

Figure 4:
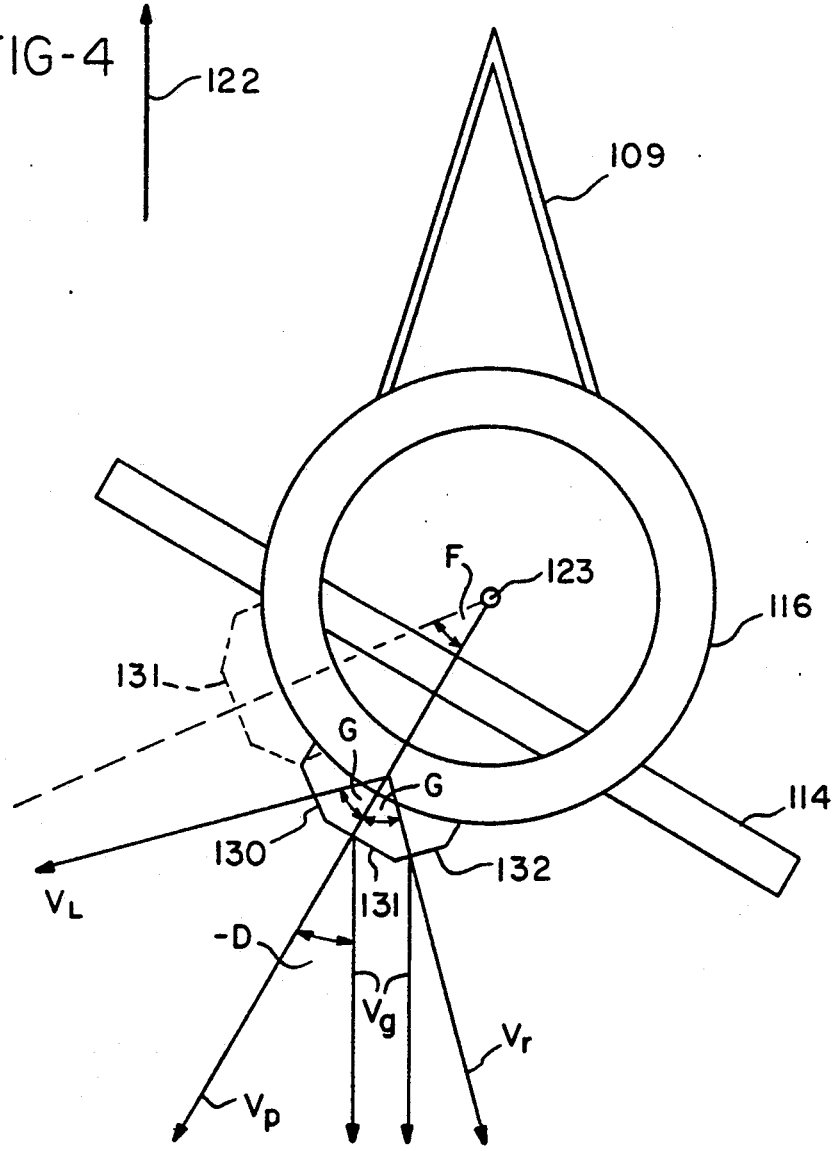
FIG. 4 is a schematic plan view of a ring and a blade of a motorgrader rotated in a clockwise position and showing the velocity components used to determine the angle of rotation of the blade relative to its direction of travel.
Figure 5:
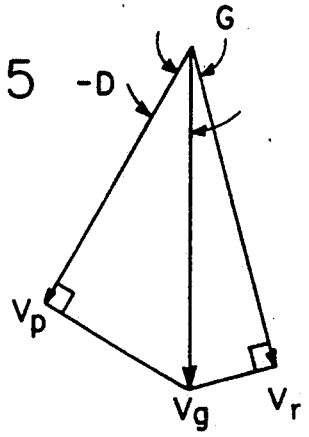
FIG. 5 is a line drawing used to illustrate derivation of the equation used to calculate the angle of rotation of the blade when the ring and the blade are positioned as shown in FIG. 4.
Figure 6:
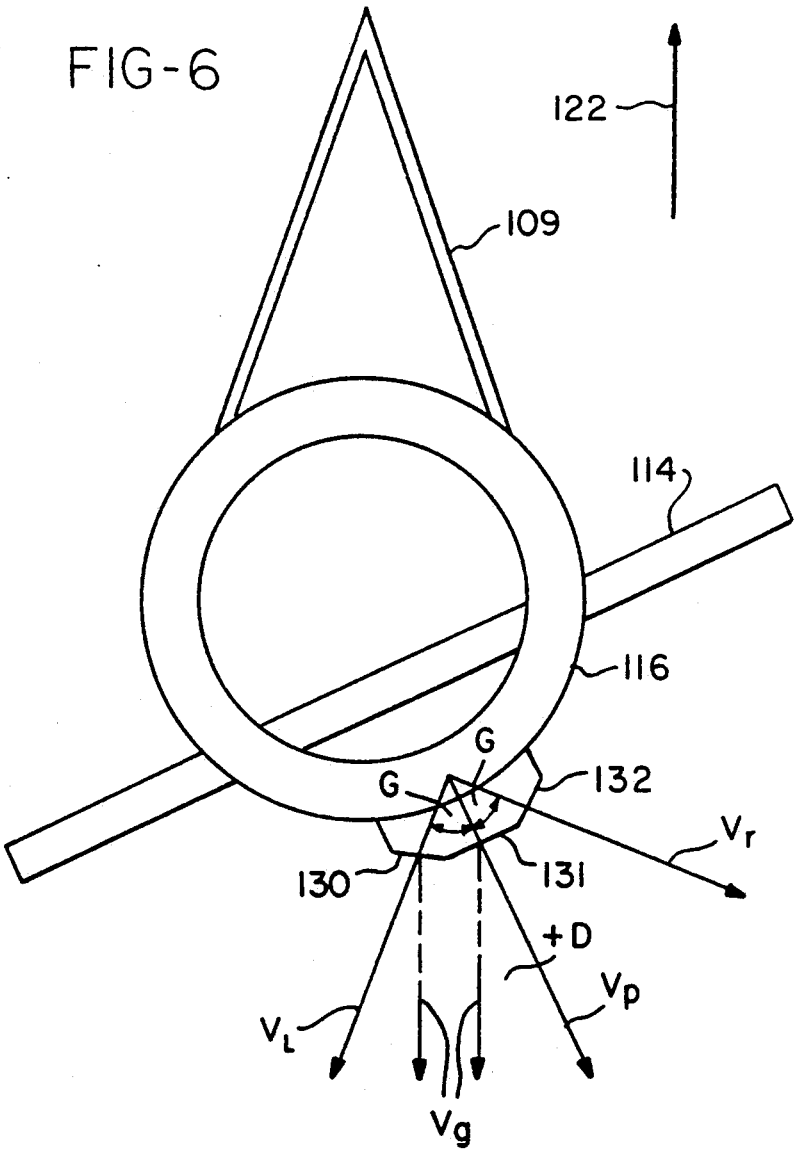
FIG. 6 is a schematic plan view of a ring and a blade of a motorgrader rotated in a counter-clockwise position and showing the velocity components used to determine the angle of rotation of the blade.
Figure 7:
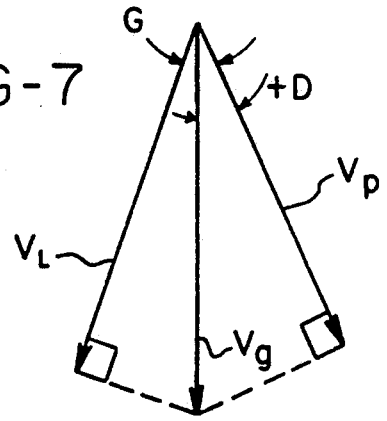
FIG. 7 is a line drawing used to illustrate derivation of the equation used to calculate the angle of rotation of the blade when the ring and the blade are positioned as shown in FIG. 6.

As best shown in FIGS. 4, 6 and 10, a first doppler effect device 131 is mounted perpendicular to the cutting edge 115 of the blade 114 and measures a component Vp of the ground velocity vector Vg perpendicular to the blade 114. The signal beam of the first doppler effect device 131 will be aligned to a radius of the ring rotation axis 123. This will render the Vp value immune to faulty readings during ring rotation. Second and third doppler effect devices 130 and 132 are each mounted symmetrically at some angle G, here shown as 45 degrees, from a first doppler effect device 131 and on opposite sides thereof. The device 130 measures a component Vl of the ground velocity vector Vg which is at an angle G to the left of the component Vp while the device 132 measures the component Vr of the ground velocity vector Vg which is at angle G to the right of the component Vp, see FIGS. 4–7.

While three doppler effect devices 130–132 are employed in the illustrated embodiment, only measurements from two of the devices will be used at any one time by the processor 138 for determining the angle of rotation D of the blade 114. The velocity component Vp measured by the device 131 will always be employed. Between velocity components Vl and Vr, the one having the largest magnitude will be the second measurement employed by the processor 138 to determine the angle of rotation D. This is because the accuracy of the velocity measurements made by the devices 130–132 decreases as the measured velocity component approaches zero.

Thus, if the blade 114 is rotated clockwise from a position perpendicular to the direction of travel 122, as shown in FIG. 4, measurements made by the devices 131 and 132 will be employed in order to determine angle D. Note that as the blade 114 is rotated clockwise the velocity component Vl measured by device 130 decreases until it reaches zero when the value of angle D equals −(90°-G). If the blade 114 is rotated counter-clockwise from a position perpendicular to the direction of travel of the blade 114, as shown in FIG. 6, measurements made by devices 130 and 131 will be employed to determine angle D. The processor 138 is programmed to make the comparison between the magnitudes of the two measured velocity components Vl and Vr in order to determine which measured velocity component Vr or Vl will be employed by the processor 138 to determine the angle D.

The processor 138 is also capable of determining the direction of angular rotation of the blade 114 by employing the values of the velocity components Vr and Vl. If Vl is greater than Vr, as will be the case if the blade rotates counter-clockwise from a position perpendicular to the direction of travel of the blade 114, as shown in FIG. 6, the processor will find that the angle of rotation D is a positive value. If, however, Vr is greater than Vl, as will be the case if the blade 114 rotates clockwise, as shown in FIG. 4, the processor 138 will find that the angle of rotation D is a negative value.

An equation will now be developed, which will be employed by the processor 138, for determining the angle of rotation D of the blade 114 relative to the direction of travel of the blade when the velocity component measurements from devices 131 and 132 are employed. By making reference to FIG. 5, which is a line drawing illustrating the velocity components Vp and Vr used to determine angle D, the following derivation of equation (a) should be apparent.

$$Vp = Vg \cos D$$
$$Vr = Vg \cos (D + G)$$

$$\frac{Vp}{\cos D} = \frac{Vr}{\cos (D + G)}$$

$$\frac{\cos (D + G)}{\cos D} = \frac{Vr}{Vp}$$

$$\frac{\cos D \cos G - \sin D \sin G}{\cos D} = \frac{Vr}{Vp}$$

$$\cos G - \sin G \tan D = \frac{Vr}{Vp}$$

$$\cos G - \frac{Vr}{Vp} = \sin G \tan D$$

$$\frac{\cos G - Vr/Vp}{\sin G} = \tan D$$

$$\cot G - \frac{Vr}{Vp \sin G} = \tan D$$

-continued $$D = \arctan(\cot G - Vr/Vp \sin G) \quad \text{(a)}$$

A further equation will be developed, which will be employed by the processor 138, for determining the angle of rotation D of the blade 114 relative to the direction of travel 122 of the blade 114 when the measurements from device 130 and 131 are employed. By making reference to FIG. 7, which is a line drawing illustrating the velocity components Vp and Vl used to determine angle D, the following derivation of equation (b) should be apparent.

$$Vp = Vg \cos D$$
$$Vl = Vg \cos(D - G)$$

$$\frac{Vp}{\cos D} = \frac{Vl}{\cos(D - G)}$$

$$\frac{\cos(D - G)}{\cos D} = \frac{Vl}{Vp}$$

$$\frac{\cos D \cos G + \sin D \sin G}{\cos D} = \frac{Vl}{Vp}$$

$$\text{Cos } G + \sin G \tan D = \frac{Vl}{Vp}$$

$$\sin G \tan D = \frac{Vl}{Vp} - \cos G$$

$$\tan D = \frac{Vl}{Vp \sin G} - \frac{\cos G}{\sin G}$$

$$\tan D = \frac{Vl}{Vp \sin G} - \cot G$$

$$D = \arctan\left(\frac{Vl}{Vp \sin G} - \cot G\right) \quad \text{(b)}$$

It is contemplated that all three doppler effect devices 130–132 may be mounted offset such that the first doppler effect device 131 is shifted some horizontal angle F to the side of the perpendicular to the blade, as shown in broken line in FIG. 4. If the 3 doppler effect devices are mounted in this manner, equations (a) and (b) above would be modified as follows:

$$D = \arctan\left[\cot G - \frac{Vr}{Vp \sin G}\right] + F \quad \text{(a)}$$

$$D = \arctan\left[\frac{Vl}{Vp \sin G} - \cot G\right] + F \quad \text{(b)}$$

Figure 8:
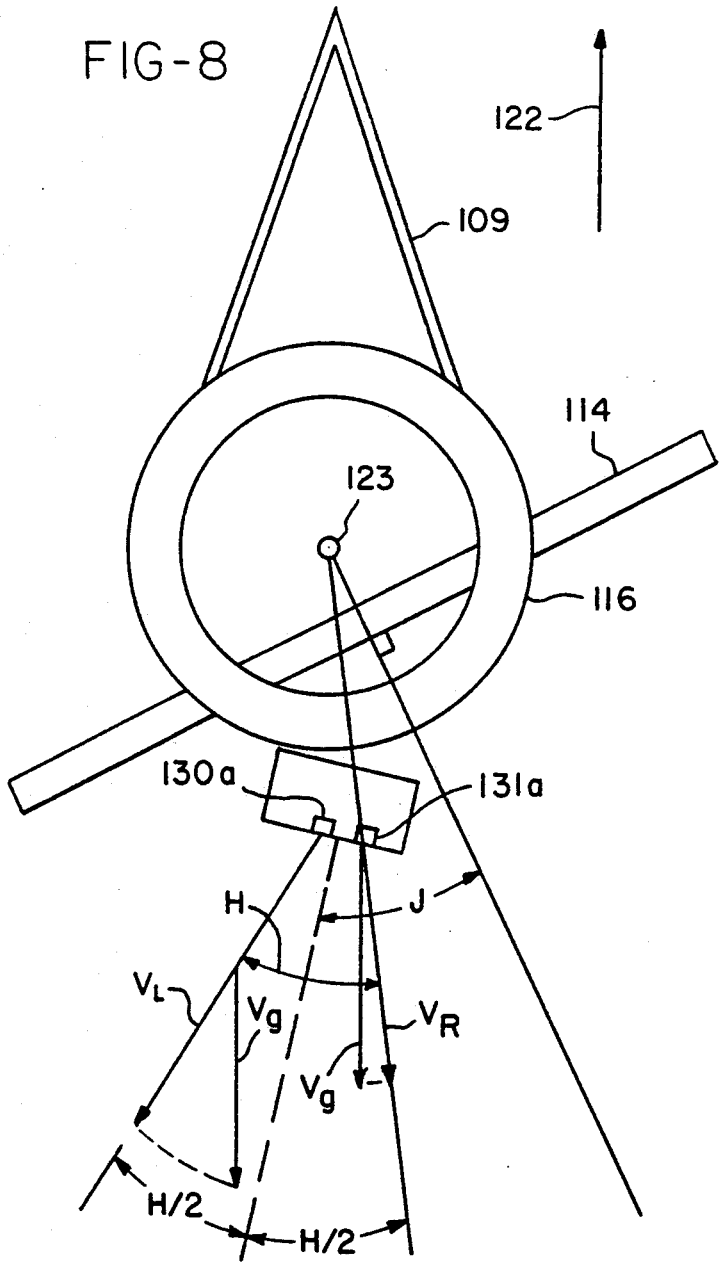
FIG. 8 is a schematic plan view of a ring and a blade of a motorgrader having an alternative embodiment of the blade angle measuring means and showing the velocity components used to determine the angle of rotation of the blade while employing this embodiment.

The noncontact blade angle measuring means 126 may alternatively comprise only two doppler effect devices 130*a* and 131*a*, as shown in FIG. 8. The first doppler effect device 131*a* would be mounted so that its signal beam would be aligned to a radius of the ring rotation axis 123. The other device 130*a* would be mounted at some angle H to one side of the first device 131*a*. Since only two devices are being employed, the devices must be able to determine not only the magnitude of its respective ground velocity vector component aligned to its antenna, but also determine whether the component points towards or away from the sensor. An example of this type of sensor would be a modified model MSM1040 available from Alpha Industries, Inc. Such a sensor would require, for example, two mixer diodes placed in the waveguide. The diodes would be separated by a fraction of a wavelength, thus producing doppler outputs differing in phase. The phase shift between the two outputs would be used to determine whether the velocity component points away from or toward the sensor and thus whether the blade rotation angle D is clockwise or counter-clockwise from the ground velocity vector Vg.

Figure 9:
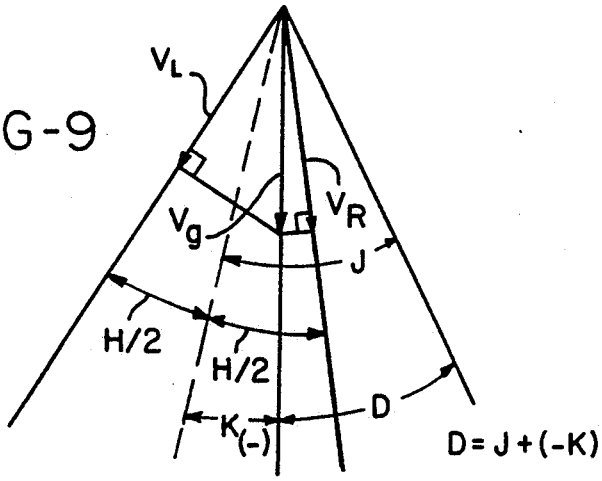
FIG. 9 is a line drawing used to illustrate derivation of the equation used to calculate the angle of rotation of the blade when the embodiment shown in FIG. 8 is employed.

An equation will now be developed, which will be employed by the processor 138, for determining the angle of rotation D of the blade 114 when the devices 130*a* and 131*a* are employed. By making reference to FIG. 9, which is a line drawing illustrating the velocity components Vr and Vl used to determine angle D, the following derivation of equation (c) should be apparent.

$$Vl = Vg \cos(K + H/2) \qquad Vr = Vg \cos(K - H/2)$$

$$Vg = \frac{Vl}{\cos(K + H/2)} \qquad Vg = \frac{Vr}{\cos(K - H/2)}$$

$$\frac{Vl}{Vr} = \frac{\cos(K + H/2)}{\cos(K - H/2)} = \frac{\cos K \cos H/2 + \sin K \sin H/2}{\cos K \cos H/2 - \sin K \sin H/2}$$

$$\frac{Vl}{Vr}(\cos K \cos H/2) - \frac{Vl}{Vr}(\sin K \sin H/2) = \cos K \cos H/2 + \sin K \sin H/2$$

$$\cos K \cos H/2 \frac{(Vl)}{Vr} - \cos K \cos H/2 = \sin K \sin H/2 \frac{(Vl)}{Vr} + \sin K \sin H/2$$

$$\cos K\left(\frac{Vl}{Vr} - 1\right)\cos H/2 = \sin K\left(\frac{Vl}{Vr} + 1\right)\sin H/2$$

$$\frac{\sin K}{\cos K} = \frac{(Vl/Vr - 1)\cos H/2}{(Vl/Vr + 1)\sin H/2}$$

$$\tan K = \frac{(Vl/Vr - 1)}{(Vl/Vr + 1)} \cot H/2$$

$$K = \arctan\left[\frac{(Vl - Vr)}{(Vl + Vr)} \cot H/2\right]$$

$$D = K + J$$

$$D = \arctan\left[\frac{(Vl - Vr)}{Vl + Vr} \cot H/2\right] + J \quad \text{(c)}$$

A final equation will be developed which will be employed by the blade slope control processor 138 for controlling the cross slope cut by the motorgrader 100. The following angular orientations are monitored or controlled by the slope control processor 138: B - the parallel slope angle of the blade 114; A - the desired cross slope angle as selected by the operator using the blade slope reference 118; C - the perpendicular slope angle of the blade 114; and, D - the angle of rotation of the blade 114 relative to the direction of travel 122 of the blade 114. By making reference to FIG. 11, which is a line drawing illustrating movement of the cutting edge 115 of the blade 114, the derivation of equation (d) which follows should be apparent. The line segment designations are relative and utilized only to derive equation (d).

$$\tan B = \text{parallel blade slope}$$

-continued $$\tan A = \text{cross slope} = \frac{g}{e}$$

$$\tan C = \text{perpendicular blade slope} = \frac{g - c}{f}$$

$$e = \sqrt{f^2 + a^2} \qquad g = f \tan C + c$$
$$f = a \tan D \qquad c = a \tan B$$

$$\tan A = g/e = (f \tan C + c)/\sqrt{f^2 + a^2}$$

$$\tan A = \frac{a \tan D \tan C + a \tan B}{\sqrt{(a \tan D)^2 + a^2}}$$

$$\tan A = \frac{a (\tan D \tan C + \tan B)}{\sqrt{a^2 (\tan D)^2 + a^2}}$$

$$\tan A = \frac{\tan D \tan C + \tan B}{\sqrt{\tan^2 D + 1}}$$

The following trigonometric identity is substituted into the above equation $$\cos D = \frac{1}{\sqrt{\tan^2 D + 1}}$$

$$\tan A = \cos D \tan D \tan C + \cos D \tan B$$

$$\tan A = \cos D \frac{\sin D}{\cos D} \tan C + \cos D \tan B$$

$$\tan A = \sin D \tan C + \cos D \tan b$$

$$\tan B = \frac{\tan A - (\tan C)(\sin D)}{\cos D} \qquad \text{(d)}$$

where B is the required parallel blade slope angle of the blade 114 parallel to its cutting edge 122 and relative to horizontal; A is the desired cross slope angle of the surface; C is the sensed perpendicular angle of the blade 114 relative to horizontal; and, D is the angle of rotation of the blade 114 relative to its direction of travel. Equation (d) is utilized by the blade slope control processor 138 to determine the parallel blade slope angle B required to maintain the desired cross slope for a cut being performed by the motorgrader 100. The blade slope processor 138 then controls the parallel blade slope via the flow valve 140 and the cylinder 134 so that the sensed parallel blade slope angle B is maintained substantially equal to the calculated parallel blade slope angle B.

As set forth above, the accuracy of the velocity measurements made by the doppler effect devices 130–132 employed by this invention decrease as the measured velocity component approaches zero. Thus, it is contemplated by this invention to program processor 138 to store the last value of angle D before a minimum absolute velocity of component Vp si reached. The stored value of angle D will be used in the cross slope calculations while Vp is below the minimum absolute value. Once Vp reaches its minimum value, the value of angle D will once again be updated by the processor 138.

It is further contemplated by this invention that a separated non-contact ranging sensor 141, shown schematically in FIG. 3, may be employed to measure the vertical distance between the blade 114 and the ground. This sensor senses when the blade 114 has been raised a predetermined height above the ground and produces a signal representative thereof. This signal is supplied to the processor 138 instructing it to ignore all output signals from the doppler effect devices 130–132. One such ranging sensor is commercially available under the tradename Sonic Tracer from Spectra-Physics having a model No. ST2-10.

It is additionally contemplated by this invention to determine the angle of rotation D of the blade 114 relative to its direction of travel 122 by employing various alternative blade angle measuring means. For example, a blade angle measuring means could comprise a single doppler effect device such as one of the devices 130–132 which is mechanically scanned or swept across the field viewed by the devices 130–132. It is also possible to electrically sweep or scan a single doppler effect device, for example by controlling the phasing of input currents to an array of antennas. A rotating laser beam could also be utilized whereby the beam would be directed at the moving ground and the doppler shift of the reflected beam would be measured to determine the angle of rotation D. These as well as other alternate embodiments are within the skill of the art and are contemplated as being within the scope of the present invention.

While the method for operating the disclosed apparatus should be apparent from the foregoing description, a brief description will now be provided for the sake of clarity. The method for controlling the cross slope angle of a surface being worked by a motorgrader 100 comprises the steps of: selecting a desired cross slope angle A; sensing the parallel slope angle B of the blade 114 and sensing the perpendicular slope angle C of the blade 114; measuring the angle of rotation D of the blade 114 relative to its direction of travel 122; and, controlling the parallel slope angle B as a function of the desired cross slope angle A, the perpendicular slope angle C of the blade 114 and the angle of rotation D of the blade 114 relative to its direction of travel to maintain the desired cross slope C when the motorgrader 100 is operated.

The step of controlling the parallel slope angle B of the blade 114 as a function of the desired cross slope angle A, the perpendicular slope angle C of the blade 114 and the angle of rotation D of the blade 114 may comprise the steps of: calculating the required parallel slope angle using the equation:

$$\tan B = \frac{\tan A - (\tan C)(\sin D)}{\cos D}$$

where B is the required parallel slope angle of the blade; A is the desired cross slope angle of the surface; C is the sensed perpendicular blade slope angle of the blade; and D is the measured angle of rotation of the blade relative to the direction of travel of the blade; and controlling the parallel slope of the blade so that the sensed parallel slope angle of the blade is substantially equal to the calculated parallel slope angle of the blade to maintain the desired cross slope when the surface is being worked by the motorgrader 100.

Having thus described the method and apparatus of the present invention for controlling the slope of a blade on a motorgrader in detail and by reference to preferred embodiments thereof, it will be apparent that modifications and variations are possible without departing from the scope of the invention defined in the appended claims.

What is claimed is:

1. A control system for controlling the position of an adjustably movable tool having a working edge carried by a vehicle in order to maintain a desired cross slope angle of a surface being worked by the vehicle comprising:

input means for selecting a desired cross slope angle of the surface being worked;

slope sensor means for determining a sensed parallel slope angle of the tool parallel to its working edge and relative to horizontal, and a perpendicular slope angle of said tool perpendicular to its working edge and relative to horizontal;

tool angle measuring means located on the vehicle out of contact with said surface for measuring an angle of rotation of said tool relative to the direction of travel of said tool; and processor means connected to said input means, said slope sensor means and said tool angle measuring means for controlling said sensed parallel slope angle of said tool to maintain said desired cross slope angle of said surface.

2. A control system as claimed in claim 1, wherein a required parallel slope angle of said tool needed to maintain the desired cross slope angle is calculated by said processor means using the equation:

$$\tan B = \frac{\tan A - (\tan C)(\sin D)}{\cos D}$$

where B is the required parallel slope angle of said tool; A is the desired cross slope angle of the surface; C is the sensed perpendicular tool slope angle of said tool; and D is said angle of rotation of said tool relative to the direction of travel of said tool measured by said tool angle measuring means, and said processor means controls said sensed parallel slope angle of said tool so that the sensed parallel slope angle of said tool is substantially equal to the required parallel slope angle of said tool to maintain said desired cross slope angle of said surface being worked by said vehicle.

3. A control system as claimed in claim 1, wherein said vehicle further comprises ring means for mounting said tool to said vehicle, and said slope sensor means and said tool angle measuring means are mounted onto said ring means.

4. A control system as claimed in claim 1, wherein said slope sensor means comprises first and second slope sensors.

5. A control system as claimed in claim 1, wherein said slope sensor means comprises a single dual axis slope sensor.

6. A control system as claimed in claim 1, wherein said tool angle measuring means comprises at least one doppler effect device.

7. A control system as claimed in claim 6, wherein said tool angle measuring means comprises two doppler effect devices.

8. A control system as claimed in claim 7, wherein each of said two doppler effect devices further includes means for determining the rotational direction of said tool relative to its direction of travel.

9. A control system as claimed in claim 6, wherein said tool angle measuring means comprises three doppler effect devices.

10. In a motorgrader having a blade with a cutting edge supported upon a ring unit, the blade and the ring unit being rotatable about a generally vertical axis and being mounted for adjustment of the elevations of the ends of the blade to define a sensed parallel slope angle of the blade relative to horizontal, apparatus for controlling a cross slope angle of a surface being worked by the motorgrader comprising:

input means for selecting a desired cross slope angle of the surface being worked;

slope sensor means for determining the sensed parallel slope angle of the blade parallel to its cutting edge and relative to horizontal, and a perpendicular slope angle of said blade perpendicular to its cutting edge and relative to horizontal;

blade angle measuring means located on the motorgrader out of contact with said surface for measuring an angle of rotation of said blade relative to the direction of travel of said blade; and processor means connected to said input means, said slope sensor means and said blade angle measuring means for controlling said sensed parallel slope angle of said blade to maintain said desired cross slope angle of said surface.

11. Apparatus for controlling the cross slope of a surface being worked by a motorgrader as claimed in claim 10, wherein a required parallel slope angle of said blade needed to maintain the desired cross slope angle is calculated by said processor means using the equation:

$$\tan B = \frac{\tan A - (\tan C)(\sin D)}{\cos D}$$

wherein B is the required parallel slope angle of said blade; A is the desired cross slope angle of the surface; C is the sensed perpendicular blade slope angle of said blade; and D is the measured angle of rotation of said blade relative to the direction of travel of said blade, and said processor means controls said sensed parallel slope angle of said blade so that the sensed parallel slope angle of said blade is substantially equal to the required parallel slope angle of said blade to maintain said desired cross slope angle of said surface being worked by said motorgrader.

12. Apparatus for controlling the cross slope of a surface being worked by a motorgrader as claimed in claim 10, wherein said slope sensor means and said blade angle measuring means are mounted onto said ring unit.

13. Apparatus for controlling the cross slope of a surface being worked by a motorgrader as claimed in claim 10, wherein said slope sensor means comprises first and second slope sensors.

14. Apparatus for controlling the cross slope of a surface being worked by a motorgrader as claimed in claim 10, wherein said slope sensor means comprises a single dual axis slope sensor.

15. Apparatus for controlling the cross slope of a surface being worked by a motorgrader as claimed in claim 10, wherein said blade angle measuring means comprises at least one doppler effect device.

16. In a motorgrader having a blade with a cutting edge supported upon a ring unit, the blade and the ring unit being rotatable about a generally vertical axis and being mounted for adjustment of the elevations of the ends of the blade to define an actual parallel slope angle of the blade relative to horizontal, a method for controlling a cross slope angle of a surface being worked by the motorgrader comprising the steps of:

selecting a desired cross slope angle;

sensing the actual parallel slope angle of the blade parallel to its cutting edge and relative to horizontal;

sensing a perpendicular slope angle of said blade perpendicular to its cutting edge and relative to horizontal;

providing angle measuring means mounted onto said motorgrader out of contact with said surface;

measuring an angle of rotation of said blade relative to the direction of travel of said blade with said angle measuring means, controlling said actual parallel slope angle of said blade as a function of the desired cross slope, the perpendicular slope angle of said blade and the angle of rotation of said blade relative to the direction of travel of said blade to maintain said desired cross slope angle of said surface being worked by said motorgrader.

17. A method for controlling the cross slope angle of a surface being worked by a motorgrader as claimed in claim 16, wherein the step of controlling said actual parallel slope angle of said blade as a function of the desired cross slope, the perpendicular slope angle of said blade and the angle of rotation of said blade relative to the direction of travel of said blade comprises the steps of calculating a required parallel slope angle using the equation:

$$\tan B = \frac{\tan A - (\tan C)(\sin D)}{\cos D}$$

where B is the required parallel slope angle of said blade; A is the desired cross slope angle of the surface; C is the sensed perpendicular blade slope angle of said blade; and D is the measured angle of rotation of said blade relative to the direction of travel of said blade; and controlling the actual parallel slope angle of said blade so that the actual parallel slope angle of said blade is substantially equal to the required parallel slope angle of said blade to maintain said desired cross slope angle of said surface being worked by said motorgrader.

18. A method for controlling the cross slope angle of a surface being worked by a motorgrader as claimed in claim 16, wherein said step of sensing said actual parallel slope angle of said blade and said step of sensing said perpendicular slope angle of said blade, comprises the step of providing a slope sensor means located on said ring unit.

19. A method for controlling the cross slope angle of a surface being worked by a motorgrader as claimed in claim 16, wherein said step of providing angle measuring means, comprises the step of providing angle measuring means located on said ring unit.

20. A method for controlling the cross slope angle of a surface being worked by a motorgrader as claimed in claim 16, wherein said step of providing angle measuring means, comprises the step of providing angle measuring means comprising at least one doppler effect device.

21. A method for controlling the cross slope angle of a surface being worked by a motorgrader as claimed in claim 18, wherein said step of providing a slope sensor means located on said ring unit, comprises the step of providing a slope sensor means located on said ring unit comprising first and second slope sensors.

* * * * *